United States Patent [19]

Ulinskas

[11] 4,444,163

[45] Apr. 24, 1984

[54] AIR METERING SYSTEM FOR DIESEL ENGINE

[75] Inventor: Gary J. Ulinskas, La Jolla, Calif.

[73] Assignee: Whittaker Corporation, Los Angeles, Calif.

[21] Appl. No.: 266,641

[22] Filed: May 26, 1981

[51] Int. Cl.[3] ..... F02B 77/00

[52] U.S. Cl. ..... 123/198 E; 114/349

[58] Field of Search ..... 114/336, 337, 338, 349; 123/559, 564, 198 D, 198 E

[56] References Cited

U.S. PATENT DOCUMENTS

| | | | |
|---|---|---|---|
| 1,704,082 | 3/1929 | Goode | 123/564 |
| 3,367,315 | 2/1968 | Whittle | 114/337 X |

FOREIGN PATENT DOCUMENTS

| | | | |
|---|---|---|---|
| 372391 | 3/1923 | Fed. Rep. of Germany | 123/198 E |
| 523232 | 4/1921 | France | 123/564 |

*Primary Examiner*—Michael Koczo

*Attorney, Agent, or Firm*—Henry M. Bissell

[57] ABSTRACT

A system for limiting the air intake to a diesel engine or the like under restricted operating conditions. A closure valve is mounted in the air intake passage of a diesel engine. The system includes a fluid pressure responsive mechanism for closing the valve under restricted operating conditions, and an orifice positioned downstream of the valve and sized to the particular engine associated therewith. The orifice is sized to permit air flow into the air intake passage of the engine at a rate which is about 60% of the normal, full-flow rate for normal engine operation at specified RPMs. The pressure responsive mechanism is coupled to a closed atmosphere pressurizing system so as to be actuated in closing the air intake valve when the pressurizing system is activated and to automatically permit the air intake valve to be opened when the pressurizing system is deactivated or when its pressurized fluid is exhausted.

14 Claims, 3 Drawing Figures

AIR METERING SYSTEM FOR DIESEL ENGINE

BACKGROUND OF THE INVENTION

1. Field of the Invention

This invention relates to air intake control mechanisms for diesel engines or the like, and more particularly, for such engines drawing air from an enclosed space which is provided with air from a compressed air source.

2. Description of the Prior Art

The present invention is particularly adapted for use with diesel engines installed in enclosed lifesaving vessels known as survival capsules. Such vessels have been developed as an improvement over conventional lifeboats and are particularly designed for installation and use on offshore oil well drilling platforms.

Survival capsules as presently designed are sturdy, self-propelled vessels, totally enclosed with hatches or ports for ingress and egress. These hatches can be closed and sealed against the inlet of water; and the vessel has a self-righting capability so that it can recover from a complete roll-over, as may happen in heavy seas, and still operate to carry its passengers to safety. These vessels are presently sized in ranges from 30- to 50-man capacities. Typically, the survival capsules are stored at a level just below the main deck of a well-drilling platform; and the associated survival system includes a single cable, releasable hook, and powered winch for lowering the capsule to the water and releasing it under circumstances where the need for rescue from, or abandonment of, the platform may arise.

In the environment in which survival capsules are designed for principal use, situations can develop where the capsule should be capable of operating in a flammable gas or liquid environment or, indeed, must be able to propel itself through seas covered with burning fuel. Such a situation can arise in an oil well platform disaster resulting in spillage of oil into the ocean ith the possibility or existence of fire over an extended surface area. If the disaster is such that the platform must be abandoned, the capsule should have the capability of protecting its occupants from the flames on the ocean surface while propelling itself to a safe area. Systems have been developed for dealing with this problem wherein compressed air bottles are stored in the vessel for providing fresh air within the vessel at a slight positive pressure when all hatches and ports are sealed. Thus, the flames and/or noxious and possibly flammable gases in the environment surrounding the vessel are prevented from entering the capsule to the jeopardy of its occupants. A problem, however, with this system arises from the fact that the diesel engine constituting the propulsion means for the capsule draws its intake air from the interior of the capsule, thus competing with the occupants of the capsule for the use of this compressed air in sustaining life.

Diesel engines of the type employed in survival capsules of the type described have the capability of continuing to operate and develop some power, even though substantially starved for intake air needed for internal combustion in the engine. Although power output is degraded under such conditions, the engine is still capable of developing the power needed to drive the capsule at reduced operating ratings where the intake air is restricted down to as low as 60% of the air normally drawn into the engine under unrestricted operating conditions. It is considered desirable to provide a system which will automatically restrict the air intake to the diesel engine while the capsule is being operated under sealed conditions with air being supplied from compressed air bottles on board and to automatically restore the engine intake air to full levels when the vessel is no longer being operated under such conditions.

SUMMARY OF THE INVENTION

In brief, arrangements in accordance with the present invention include a selectively operable valve mounted in the air intake passage of a diesel engine or the like. This valve is capable, when actuated, of completely closing off the air intake passage in which it is mounted. Downstream of this valve—that is, between the valve and the engine—is an orifice in the wall of the air intake passage. This orifice is particularly sized to the engine with which the intake passage is associated so that a predetermined amount of air will still be admitted to the engine, even though the valve is fully closed. Preferably, this predetermined amount of air may be approximately 60% of the amount normally used by the engine when the intake passage is not restricted, at the operating speed of the engine selected for sealed capsule propulsion conditions. In other words, the cross-sectional area of the orifice is preferably sized to reduce engine RPM by 5%. (Example—if free running engine speed is 2700 RPM, the engine will run at 2565 RPM, or 0.95 times 2700 RPM when the system is operating.)

The intake passage valve can be held closed by means of an actuator rod attached to a pressure responsive actuator mounted in a tee configuration opposite the valve. A spring can be provided to bias the intake valve to the normally closed position, but intake manifold vacuum normally opens the valve as needed to supply air to the engine. The actuator is coupled via a hose to the low pressure side of a pressure regulator which is mounted in the compressed air system provided for supplying air from compressed air sources on board the vessel and maintaining it at a slight positive pressure, relative to outside ambient pressure, when the vessel is being operated under sealed conditions.

By virtue of this arrangement, whenever the valve to the compressed air source is open, and so long as there is compressed air in the bottles, the actuator maintains the engine air intake valve closed, thus limiting the air intake to that which can be drawn through the orifice and preventing the engine from taking from the cabin atmosphere more air than is necessary to permit the engine to operate. As soon as the pressure system is deactivated, as by closing the valve at the pressure source, the actuator automatically releases the engine air intake valve, permitting it to open and restoring the condition for optimum operating of the engine. Should the compressed air in the air bottle system be exhausted during operation of the capsule under sealed conditions, the actuator will return to the deactivated condition, thus allowing the engine air intake valve to open and permitting the engine to return to normal operation. However, by this time the capsule will have reached safe water and the engine can now take air from the outside at full rate as in normal operation. In such an event, the change in engine operation, evidenced by a change in engine RPMs and engine sound, will alert those on board that the compressed air is exhausted and that cabin air is being drawn into the engine without restriction.

DESCRIPTION OF THE DRAWING

A better understanding of the present invention may be had from a consideration of the following detailed description, taken in conjunction with the accompanying drawings in which.

DESCRIPTION OF THE PREFERRED EMBODIMENT

Figure 1:
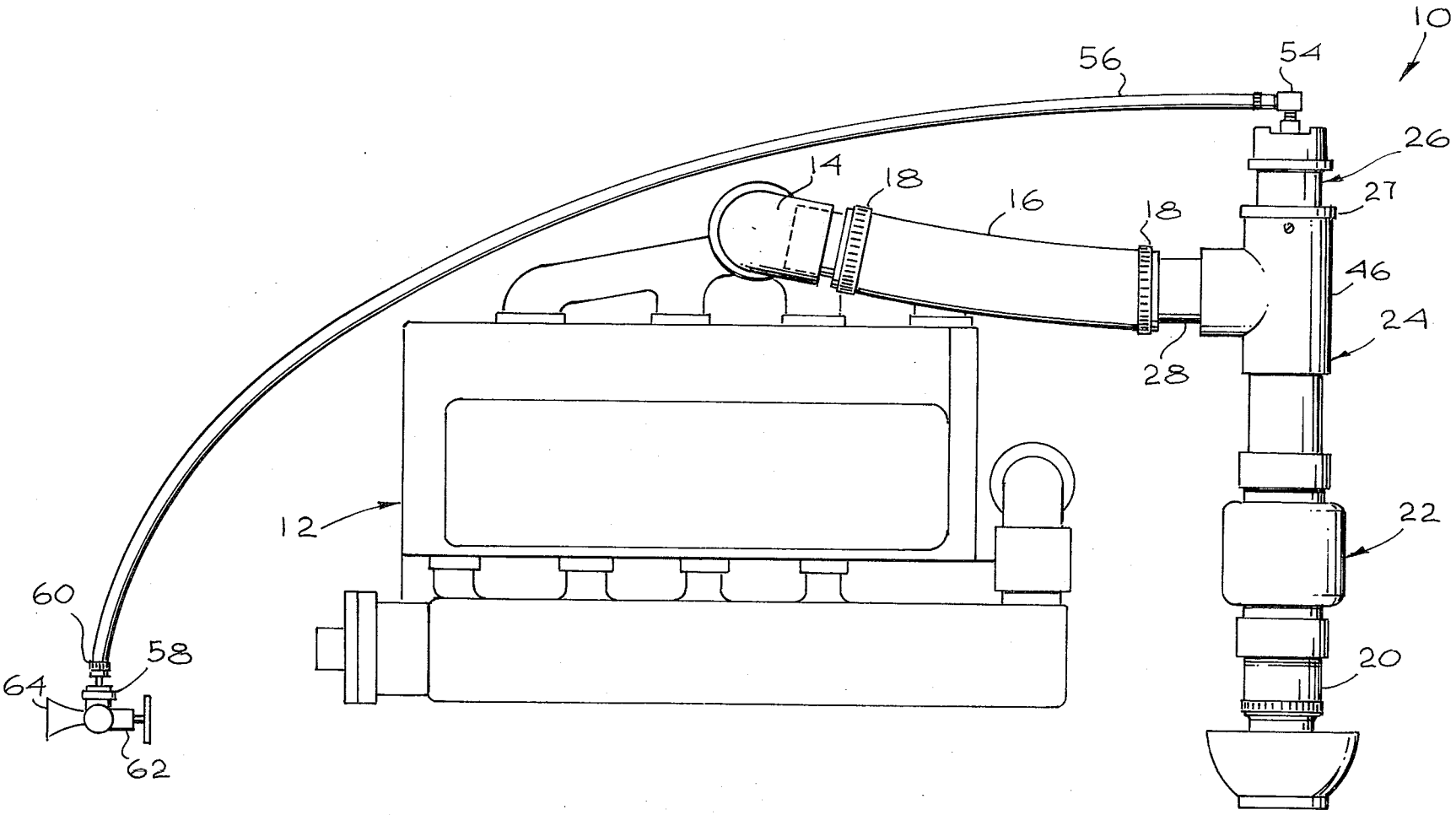
FIG. 1 is a diagram showing an intake system in accordance with the present invention coupled for operation with an associated engine.

As shown generally in FIG. 1, an air intake control system 10 in accordance with the present invention is coupled to the intake manifold of an internal combustion engine 12 by conventional means such as an elbow 14, a hose 16 and hose clamps 18.

Figure 2:
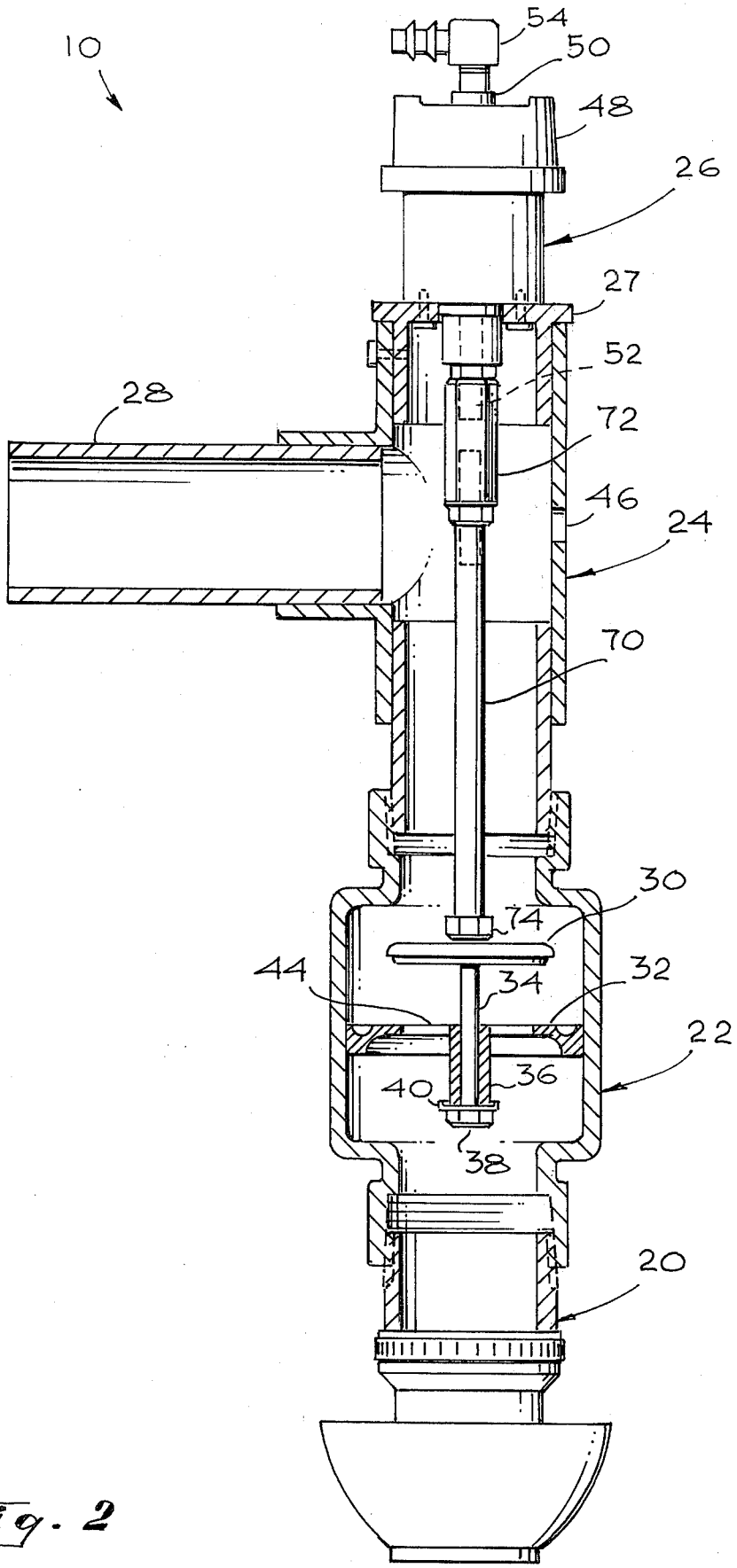
FIG. 2 is an enlarged sectional view showing details of the system of FIG. 1.

As is more particularly shown in FIG. 2, the system 10 comprises an inlet or air intake port 20 coupled to a valve chamber 22 which in turn is coupled to a tee junction section 24. At the opposite end of the cross bar portion of the tee junction section from the valve chamber 22, there is mounted a fluid pressure responsive actuator 26. The leg portion of the tee junction comprises a further coupling 28 which extends to the hose 16. An adaptor member 27 is provided for mounting the actuator 26 in position at one end of the tee junction 24.

The valve chamber 22 includes a valve 30 mounted on a transverse wall member 32 by a valve stem 34 which is slidably received and supported by a centrally located valve support member 36. A nut 38 threaded on the distal end of the valve stem 34 and a retainer plate 40 serve to retain the valve 30 within the support member 36. A plurality of openings 44 in the tranverse wall member 32 permit intake air to flow from the intake port 20 to the interior of the intake passage within the tee junction 24 subject to control by the valve 30. The valve 30 may be pulled away from the wall member 32 to permit intake air to flow through the openings 44 when the engine is operating, by virtue of the vacuum developed in the intake passage. Intake air is also permitted to enter the intake passage through an inlet orifice 46 in a wall portion of the tee junction 24. Thus, air for the internal combustion engine 12 is received through the openings 44 aand 46 when the valve 30 is opened, but is restricted to air available through the orifice 46 alone when the valve 30 is held closed.

The actuator 26 includes a diaphragm cap 48 including an internal diaphragm and piston member which are responsive to fluid pressure applied to the internal diaphragm via an inlet 50. The actuator further includes an actuator rod 52 which is extended by the internal diaphragm and piston when the actuator head 48 is pressurized. An internal spring causes the rod 52 to retract when the head is depressurized. Such actuators are commercially available from Bellofram Corporation of Burlington, Massachusetts.

An adaptor 54 is coupled to the actuator inlet 50 and is coupled to a pressure hose 56 (see FIG. 1) which in turn is coupled to a low pressure receiver 58 by means of suitable clamps 60. The receiver 58 is mounted on the downstream side of a control valve 62 which is coupled to the low pressure side of a compressed air storage bottle and low pressure regulator (not shown). When the valve 62 is opened, compressed air from the compressed air bottle is directed into the receiver 58, regulated at a pressure slightly above ambient atmospheric pressure, and released into the cabin of the vessel through the orifice 64.

Referring again to FIG. 2, an extension rod 70 is shown coupled to the actuator rod 52 by means of a coupler 72. The extension rod 70 is provided with a head 74 at its distal end for bearing against the valve 30 when the actuator rod 52 is fully extended.

Figure 3:
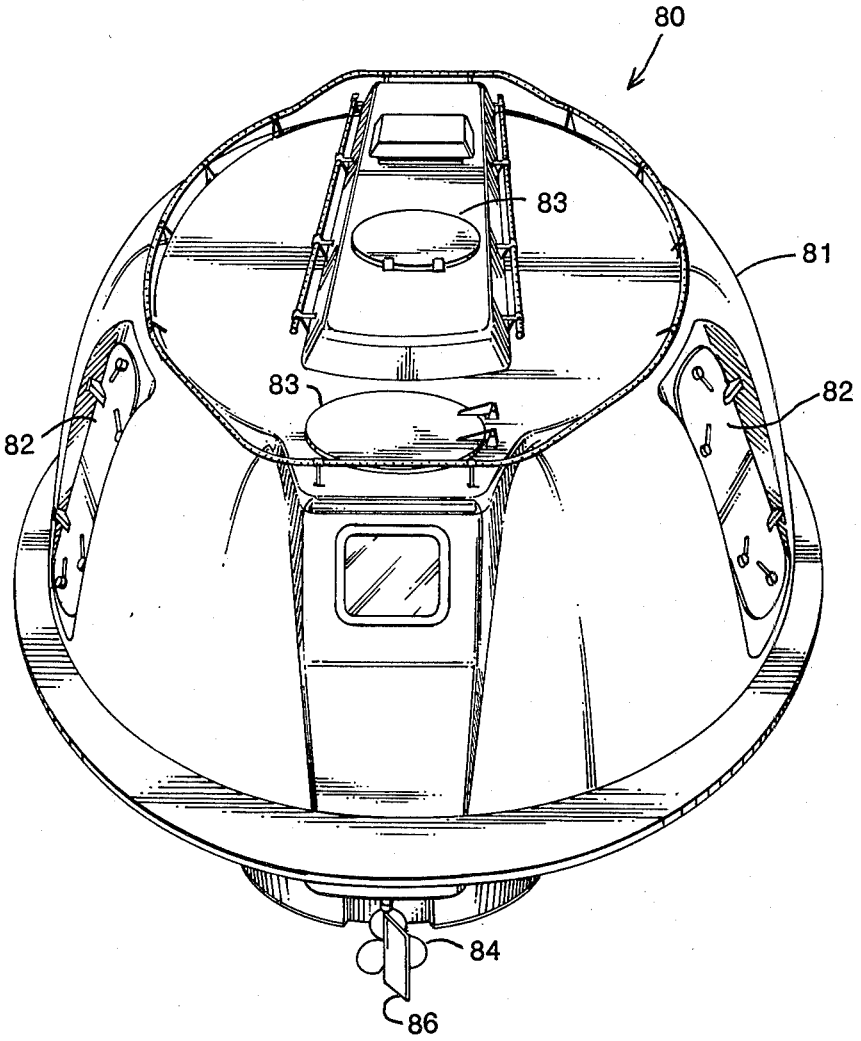
FIG. 3 is a perspective view of a survival capsule in which the intake system of FIG. 1 may be installed.

The engine 12 and associated intake system of FIGS. 1 and 2 are typically installed in a survival capsule of the type described hereinabove, such as the capsule 80 of FIG. 3. The depicted capsule 80 is fully enclosed by a shell 81 and has a capacity of approximately 30 people. Access doors and hatches 82, 83 may be dogged down, thus totally sealing the capsule 80 against the ingress of seawater during operation in high seas or in the event of capsize, also to seal off the capsule when operating in seas covered with flammable or burning oil or gases. As shown in FIG. 3, the capsule 80 is provided with a propeller 84, coupled in conventional fashion to be driven by the engine 12 inside the capsule, and a rudder 86 making up conventional driving means.

In operation, so long as the capsule 80 in which the system 10 and engine 12 are mounted is being driven under normal conditions with hatches to the outside being at least partially open to permit the free admission of air from the ambient atmosphere outside the capsule for combustion air for the engine and breathing air for the occupants, the actuator rod 52 and associated elements are in the position shown in FIG. 2. Intake manifold vacuum in the engine 12 pulls intake air through the orifice 46 and also pulls the valve 30 away from the wall member 32, thus uncovering the openings 44 and admitting additional intake air through the opening 44 as needed. However, should the capsule be operated in an environment where flames or flammable gases are present outside the capsule, the crew will then close the hatches 82, 83 and all other inlet ports to the capsule, and will open the valve 62 to provide air from the compressed air bottles to the interior of the capsule. This air is regulated at a pressure slightly above ambient atmospheric pressure outside the capsule—for example, approximately 31 psi for a sea level atmospheric pressure of 14.7 psi. Air at this elevated pressure is applied through the hose 56 to the actuator 26 via inlet 50, thus causing the actuator 26 to extend the rod 52 with its associated extension rod 70 to a point where the head 74 bears against the valve 30 and drives it to the closed position. Under such conditions, the orifice 46 is the only opening remaining available to provide intake air from the cabin to the engine. The orifice 46 is sized in accordance with a given engine size to limit the intake air to approximately 60% of the air normally used by the engine in the normal operating regimes. This restricted level of operation substantially reduces the rate at which air is taken from the cabin by the engine, thus permitting operation of the capsule for a materially increased period of time on a given number of compressed air bottles, while still permitting the engine to operate and propel the capsule through the water, albeit at slightly reduced engine output power and speed. When the pressure applied at the inlet 50 is reduced to normal ambient pressure, as when the crew shuts off the valve 62 in preparation for opening the hatches for running under normal conditions, the actuator 26 retracts the rod 52 and associated coupling elements 70, 72, 74, thereby allowing the valve 30 to be opened in response to engine intake vacuum, thus permitting engine operation at normal power and speed. The pressure at the inlet 50 will also be reduced and the actuator rod 52 will be retracted in the event that the compressed air bottle is exhausted. The occurrence of such an event is manifested to the crew by a change in engine sound and speed, thus alerting the crew to the fact that the compressed air has been exhausted and the engine is drawing air from the outside via an air intake plenum.

A system has thus been devised and is herein disclosed which provides increased safety and endurance for the operation of a lifesaving vessel, such as a survival capsule or the like, in operating through hazardous outside atmosphere with increased protection to the occupants. The system operates automatically to restrict the intake air to the propulsion engine so that the on-board compressed air source is rendered capable of providing the necessary cabin air for a longer period of time than has hitherto been the case. The enclosed system also operates automatically to restore the air intake system to normal operation when the operating crew shuts off the valve which releases compressed air from the compressed air source. Finally, the system of the present invention serves to automatically provide an indication of the exhaustion of the compressed air source, which may be used as a warning to the crew that no more compressed air is available and that the engine will soon be using outside air.

Although there have been described above specific arrangements of an improved air metering system for a diesel engine in accordance with the invention for the purpose of illustrating the manner in which the invention may be used to advantage, it will be appreciated that the invention is not limited thereto. Accordingly, any and all modifications, variations or equivalent arrangements which may occur to those skilled in the art should be considered to be within the scope of the invention as defined in the annexed claims.

What is claimed is:

1. A selectively controllable air intake system for a diesel engine or the like which is located within a generally enclosed space, the system comprising:
   - a housing coupled to the engine air intake and defining an air intake passage including an inlet port remote from the engine air intake;
   - a valve mounted within the passage for selectively blocking the admission of air from the inlet port;
   - pressure responsive means coupled to said valve to close the valve when the enclosed space is pressurized;
   - means for coupling to a storage container of compressed air for selectively pressurizing the pressure responsive means and the enclosed space to a level above ambient atmospheric pressure; and
   - means downstream of the valve for admitting air into the housing in limited amount to enable the engine to operate at a restricted power level with the valve is closed.

2. The system of claim 1 wherein the valve is mounted within the air intake passage adjacent the inlet port and is operative between open and fully closed positions.

3. The system of claim 2 wherein the pressure responsive means is effective, when actuated, to drive the valve to the closed position.

4. The system of claim 3 wherein the valve includes a closure member which is movable to an open position in response to intake manifold vacuum when the pressure responsive means is not actuated.

5. The system of claim 4 wherein the pressure responsive means comprises a linear acting actuator mounted in line with the valve and having an actuator rod for selectively closing the valve.

6. The system of claim 5 wherein the housing comprises a tee configuration with the air intake passage portion containing the valve and the actuator and rod constituting the cross bar of the tee and with the leg of the tee connecting to the engine air intake.

7. The system of claim 6 wherein the downstream means comprise a housing wall portion defining an auxiliary inlet orifice in a position located generally adjacent the intersection of the cross bar and leg of the tee.

8. The system of claim 7 wherein said orifice constitutes the sole passage for intake air to the engine when the valve is closed.

9. The system of claim 7 wherein the inlet orifice is located in the housing wall and communicates between the interior of the housing and the enclosed space.

10. The system of claim 1 wherein the pressurizing means includes a regulator and a control valve for exhausting air from the container at a controlled rate.

11. The system of claim 10 wherein the pressure responsive means is extendable to close the intake passage valve when pressurized to said level above ambient pressure.

12. The system of claim 11 wherein the pressure responsive means is retractable to permit the intake passage valve to open when the regulated pressure from the compressed air container reduces to ambient atmospheric pressure.

13. The system of claim 10 wherein the pressure responsive means comprises an actuator having a pressurized fluid access port, and wherein the means coupling the pressure responsive means to the pressurizing means includes a hose extending from the access port to a coupling with the pressurizing means.

14. A selectively controllable air intake system for an engine or the like which must be capable of operating within a sealed enclosure which defines an enclosed space, said enclosure having a depletable source of compressed air controllably dispensible into the enclosed space, comprising:
   - a housing coupled to the engine and defining an air intake passage including an inlet port for defining a fresh air intake through which air at ambient pressure may be drawn;
   - a valve mounted within the passage for selectively closing the passage for air admitted through the inlet port;
   - means for pressurizing the enclosed space with air from the depletable source to a level above ambient atmospheric pressure;
   - means coupled to said valve and responsive to the pressurizing means for controlling the valve to close the intake air passage when air at a level above ambient atmospheric pressure is available; and
   - an auxiliary intake orifice in said housing for continuously admitting air from the encosed space into the housing in limited amount when the valve is closed to enable the engine to operate at restricted power level.

* * * * *